United States Patent [19]

Lindner et al.

[11] Patent Number: 4,587,902

[45] Date of Patent: May 13, 1986

[54] SUBORDINATE-AMMUNITION MEMBER WITH TARGET-DETECTING ARRANGEMENT

[75] Inventors: Friedrich Lindner, Lauf; Helmut Kriz, Ruckersdorf, both of Fed. Rep. of Germany

[73] Assignee: Diehl GmbH & Co., Nuremburg, Fed. Rep. of Germany

[21] Appl. No.: 634,303

[22] Filed: Jul. 25, 1984

[30] Foreign Application Priority Data

Jul. 26, 1983 [DE] Fed. Rep. of Germany ..... 3326876

[51] Int. Cl.[4] ..... F42C 13/02

[52] U.S. Cl. ..... 102/213

[58] Field of Search ..... 102/213, 393, 394

[56] References Cited

U.S. PATENT DOCUMENTS 3,818,833 6/1974 Throner, Jr. ..... 102/213

4,356,770 11/1982 Atanasoff et al. ..... 102/394

FOREIGN PATENT DOCUMENTS 2353566 5/1974 Fed. Rep. of Germany .

*Primary Examiner*—Charles T. Jordan

*Attorney, Agent, or Firm*—Scully, Scott, Murphy & Presser

[57] ABSTRACT

A subordinate-ammunition member with a target-detecting arrangement, in which the arrangement externally of the wall of the member is oriented in parallel with the longitudinal axis of the member. The target detecting arrangement is arranged on a support which is movable relative thereto and is adapted be displaced from the interior outwardly of the wall structure of the subordinate-ammunition member.

7 Claims, 3 Drawing Figures

SUBORDINATE-AMMUNITION MEMBER WITH TARGET-DETECTING ARRANGEMENT

BACKGROUND OF THE INVENTION

1. Field of the Invention

The present invention relates to a secondary or subordinate-ammunition member with a target-detecting arrangement, and in which the arrangement externally of the wall of the member is oriented in parallel with the longitudinal axis of the member.

2. Discussion of the Prior Art

A subordinate or secondary-ammunition member of the kind incorporating a target-detecting arrangement has become known from the disclosure of U.S. Pat. No. 4,356,770. In that disclosure, the target-detecting arrangement is arranged on the exterior of the hollow-cylindrical housing of the subordinate-ammunition member and, with respect to the radiation energy which is to be absorbed, is oriented in parallel with the longitudinal axis of the housing. Disadvantageous, in particular, in this arrangement externally of the actual shell surface of the subordinate-ammunition member is the poor utilization of the space within the carrier projectile which transports a number of that type of superimposed stacked subordinate or secondary-ammunition members for their ejection over a target area, inasmuch as there is actually needed only a portion of the annular space available between the stack of the secondary ammunition members and the shell of the carrier projectile which is necessary; in essence, for the target-detecting arrangement. It is also disadvantageous that there is disturbed the inherently provided axial symmetry of the structure of the secondary or subordinate-ammunition member because of the externally located target-detecting arrangement which, due to high rotational speeds of spin-stabilized carrier projectiles, requires complex auxiliary constructive measures for the containment of the thereby encountered centrifugal forces.

From the disclosure of German Laid-open patent application No. 23 53 566 there has become known a similarly-constructed subordinate or secondary-ammunition member wherein the target-detecting arrangement is located entirely within its hollow-cylindrical shell surface; and in which a portion of this arrangement is located ahead of the hollow-charge insert provided for the combat charge. It is especially disadvantageous in this prior art arrangement that there is extensively hindered the formation and the firing of the projectile, which is formed from the insert upon the detonation of the combat charge. Inasmuch as such a projectile-forming insert will, even under favorable direct-shot conditions, evidence only a low target hitting radius, the target hitting effect is adversely influenced to a significant degree due to a disadvantageous influence on the projectile formation caused by installations located in front thereof and, consequently, the tactical applicability of such a subordinate-ammunition member is rendered questionable.

SUMMARY OF THE INVENTION

In recognition of these adverse conditions encountered in the prior art, it is a primary object of the present invention to equip a secondary or subordinate-ammunition member of the constructional type referred to hereinabove in such a manner with a target-detecting arrangement, that neither the conditions encountered in conjunction with the transporting over the target area, nor the conditions in conjunction with attacking of the target object (by means of the projectile-forming hollow-charge insert) are hindered by means of the requirements for an operationally-effective application of the target detecting arrangement.

The foregoing object is inventively achieved in a subordinate-ammunition member of the above-mentioned constructional type wherein, in addition to the structural features set forth hereinabove, the target-detecting arrangement is arranged on a support which is movable relative thereto and is adapted to be displaced from the interior outwardly of the wall structure of the subordinate-ammunition member.

The inventive concept thus comprises in maintaining the absorption of the radiation energy from the target area exteriorly of the cylinder wall of the subordinate-ammunition member; however, for this purpose the target-detecting arrangement is positioned besides the outer wall of the subordinate-ammunition member only subsequent to the ejection of the subordinate-ammunition member from its carrier projectile. The subordinate-ammunition members which are stacked within the carrier projectile each possess standard cylindrical configurations, and thereby fill out the stacking space to an optimum extent. After the outward displacement of the support with the target-detecting arrangement from the interior space of the subordinate-ammunition member (ejected from the carrier projectile), there is then provided a geometric offset, and with respect to the weight distribution, an asymmetry with regard to the cylinder axis; however, this asymmetry is even useable with respect to such a subordinate-ammunition member which, while inclined with respect to the vertical, particularly when suspended on a braking parachute, will drop into the target area and thereby, on the basis of the oncoming flow conditions, should carry out a rotational movement.

Basically, there should be realized every suitable movement of the support with the target-detecting arrangement rearwardly of the projectile-forming hollow charge from the interior of the subordinate-ammunition member; for example, especially also a sidewise pivoting out from an originally axially-parallel position of the support on the inside of the cylinder wall structure.

Constructive conditions which are particularly simple to control are obtained when the target-detecting arrangement is arranged on a support in the form of a carriage which is linearly displaceable transverse to the cylinder axis.

The support can be completed, adjusted and tested prior to its assembly into the subordinate-ammunition member as a self-sufficient rapidly-functioning structural assembly with the sensor arrangement inclusive focusing optics for the radiation energy which is to be evaluated.

Due to the not insignificant dimensions of such a subordinate-ammunition member, it can be suitable to arrange a deflector optic ahead of the focusing optic. There can then be carried out the evaluation of the radiation energy which is absorbed along the hollow cylinder axis rearwardly of the hollow charge through an optical aperture or shutter of an especially large diameter; in effect, with a high target temperature resolution. This also allows for the restriction to a small extent of displacement, inasmuch as it is sufficient that the deflecting mirror surface which is located in proximity to the cylinder wall be displaced outwardly beyond this wall. With respect to the axial orientation of the subordinate-ammunition member, the optical aperture is thereby always located rearwardly of its hollow charge; consequently, it does not hinder the later projectile formation.

The adjusting requirements for the target detecting arrangement allow themselves to be reduced to a minimum, when the measures for the deflection and focusing of the absorbed radiation energy are combined within a monolithic member formed of radiation-transmissive material, whose external surfaces are dimensioned as mirror surfaces or as lens surfaces.

BRIEF DESCRIPTION OF THE DRAWINGS

Reference may now be had to the following detailed description of various modifications and alternatives, further features and advantages of the invention on the basis of two schematically illustrated exemplary embodiments, taken in conjunction with the accompanying drawings; in which.

DETAILED DESCRIPTION

Figure 1:
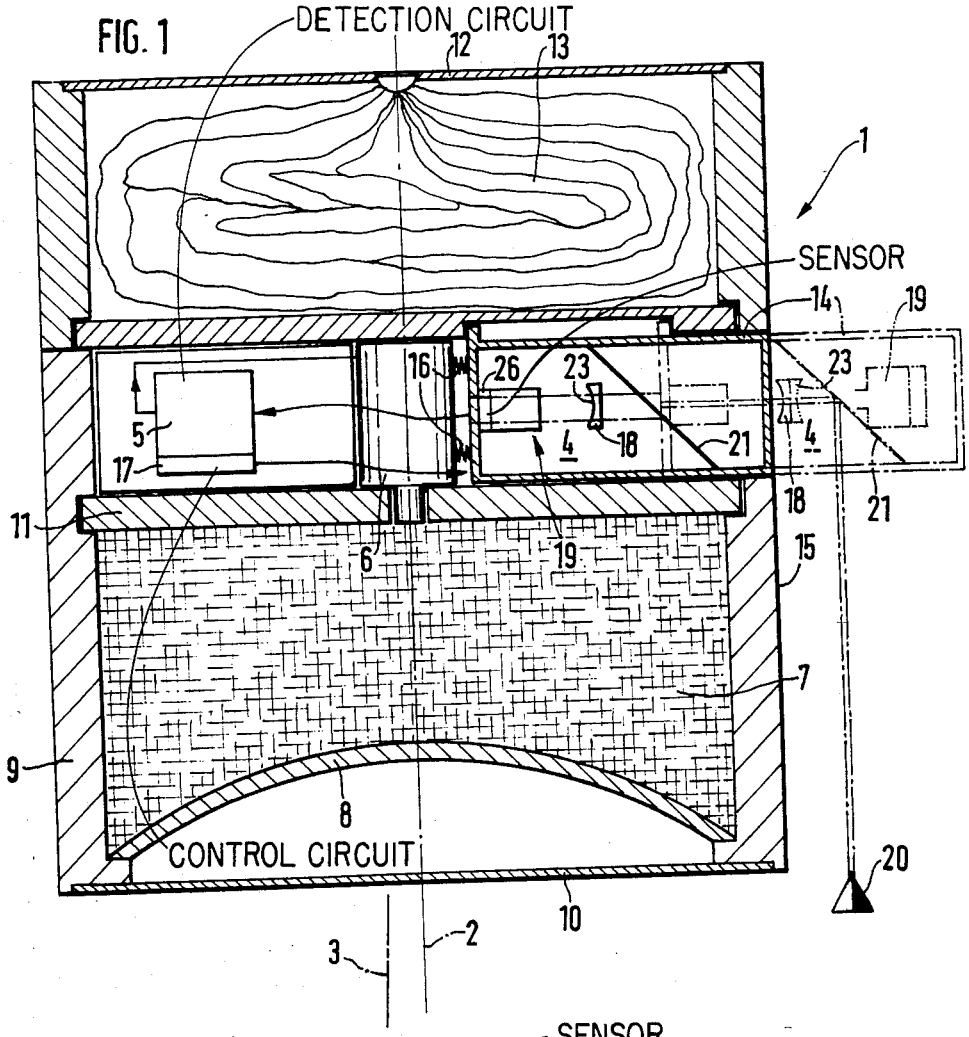
FIG. 1 illustrates an axial sectional view through a subordinate-ammunition member with a sensor carriage withdrawn therein, and with the extended position of the carriage being shown in phantom lines, so as to form a support for an infrared sensor installation.

A carrier projectile ejects a number of secondary or subordinate-ammunition members 1 over a target area (not shown). The axis 2 of each of the ammunition members 1, which is inclined relative to the horizontal 3 towards the target area, rotates about this horizontal 3. Thereby, by means of a target detecting arrangement 4, with which every subordinate-ammunition member 1 which drops into the target area is equipped, will scan the target area for a target object along a spirally-shaped narrowing trajectory. Upon the detection of a target object, a detection circuit 5 will trigger the detonator 6 for a combat or explosive charge 7 for effecting the deformation and firing of a projectile-forming hollow charge-insert 8 for attacking the detected target object.

The subordinate-ammunition member is preferably constructed as a hollow cylinder 9 which is closed off through a shutter 10 in the direction towards the target area and, on the one hand, encloses the combat charge 7 with the insert 8 below a propellant mechanism-separating wall 11 and, on the other hand, makes provision thereabove for installations for implementing the defined fall into the target area and for the detection of a target object. In addition to the infrared detecting arrangement 4, a millimeter-wave sensor can be connected to the circuit 5; thereby, in lieu of the shutter 10, there can be arranged an mmW-antenna ahead of the insert 8.

Preferably, there is provided in the hollow cylinder 9 rearwardly, below a cover plate 12, a folded parachute 13 which, after the ejection of the subordinate-ammunition member 1, will be unfolded from its carrier projectile. The fastening of the support lines or shrouds of the parachute 13 is then so selected with regard with the weight distribution within the hollow cylinder 9 so as to set the above-mentioned angular deviation of the cylinder axis 2 from the horizontal 3.

In the subordinate-ammunition member 1 which has been ejected from the carrier projectile, a target detection arrangement 4 is built into a support in the type of, for example, a thrust piston or carriage 14 which is extended into the operative position (illustrated in FIG. 1 by the phantom lines) radially outwardly of the cylinder wall 15. For this purpose, there can be provided pusher arrangements 16 in the form of energy accumulators (for example, springs), which will effect the forward movement of the carriage 14 as soon as there is eliminated the locking restraining force of a constructional component provided on the carrier projectile (as a result of ejection therefrom); or as soon as a special latching means on the subordinate-ammunition member 1 is itself released, for example, on the basis of the free-fall delay as a result of the unfolding of the braking parachute 13. As a pusher or displacing arrangement 16 there can also be provided an energy-producing element (for example, a pyrotechnic element); which is triggered by means of a control circuit 17 either dependent on time or sensor-controlled, in order to extend the sensor carriage 14 outwardly from the ejected subordinate-ammunition member 1 only after a predetermined falling period thereof. The external configuration of the portion of the carriage 14 which projects sidewise from the wall 15, in effect normal to the axis 2, can be designed so as to flow-dynamically assist in the rotational movement of the axis 2 about the horizontal 3 during the course of the subordinate-ammunition member 1 falling into the target area.

The target-detecting arrangement 4 which is built into the support carriage 14 essentially consists of an optical system 18 with a large aperture or shutter diameter and a sensor arrangement 19. In the interest of obtaining a flat-constructed arrangement for the subordinate-ammunition member 1 along the direction of the axis 2, these are located behind each other in the outwardly extending direction of the carriage 14; in effect, normal to the axis 2. For the orientation 20 in parallel with the axis 2 of the radiation energy which is absorbed by the sensor arrangement 19, there is additionally provided a deflecting mirror surface 21 on the carriage 14 for this purpose.

Figure 2:
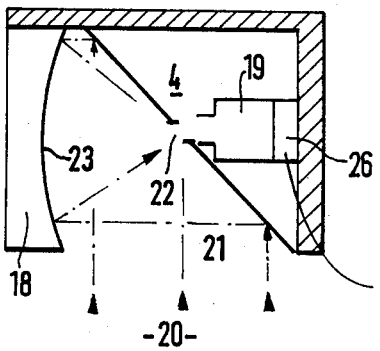
FIG. 2 illustrates a reflectively-operating deflection and focusing device for the sensor carriage.

As is also illustrated in FIG. 2, in the interest of providing a smaller-constructed target-detecting arrangement 4, provisions can be made whereby the sensor arrangement 19 is positioned behind a central opening 22 in the deflecting mirror surface 21, and oppositely located ahead of the mirror surface 21, the focusing optics 18 in the form of a concave mirror 23.

Figure 3:
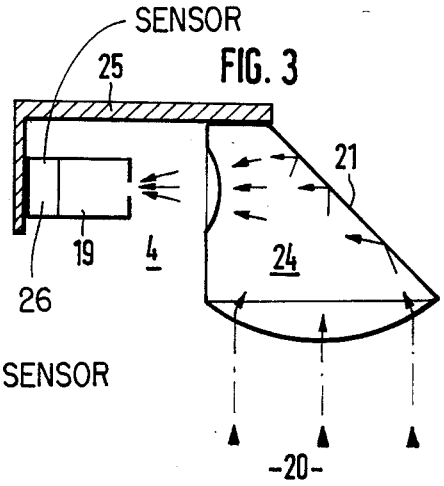
FIG. 3 illustrates a transmissively-operating deflector and focusing device for the sensor carriage.

It is less complex and critical with regard to the adjusting requirements when, in lieu of such a reflectively-operating deflecting and focusing arrangement pursuant to FIG. 2, there is provided a transmissively-operating arrangement pursuant to that shown in FIG. 3. Herein, the functions of the planar deflecting mirror surface 21 and of the spherical or apherical focusing optic are constructively combined within a prismatic member 24 constituted of a material which is transmissive to the radiation energy within the infrared range. Suitable as the material for the member 24 is, for example, polycrystalline germanium; with finishing of the lens surface for the focusing optic 18 through the employment of conventional polishing or diamond boring methods. The member 24 can be also produced from a casting of an infrared-permeable vitrous material, with subsequent finishing of its mirror and lens surfaces. A monolithic, transmissively-operating deflecting and focusing arrangement of that type evidences the particular advantage that, after final finishing it requires no further adjusting requirements; in effect, it can simply be assembled on a mounting frame 25 of the support with the sensor arrangement 19, and oriented relative to the latter.

It is even more purposeful when, through the division of the hollow cylinder 9, as illustrated in FIG. 1, the subordinate-ammunition member 1 is so assembled whereby the detector support is mounted as the sensor carriage 14 independently of the assembly of the housing components, and the combat charge 7 inclusive its insert 8, and can be adjusted with respect to the function of its target-detecting arrangement 4; and then be utilized as a self-sufficient, tested operational component.

What is claimed is:

1. Subordinate-ammunition member including a target-detecting arrangement oriented externally of the cylindrical wall structure of said member in parallel with the longitudinal axis of said member; the improvement comprising support means being displaceable from interiorly of said member externally of the wall structure thereof, and said target-detecting arrangement being relatively movably positioned on said support means.

2. Subordinate-ammunition member as claimed in claim 1, wherein the portion of said support means for the target-detecting arrangement which is movable outwardly of said cylindrical wall has a flow-profiled configuration.

3. Subordinate-ammunition member as claimed in claim 1, wherein said support means with the target-detecting arrangement is arranged for outward displacement from said member in an axially-parallel position from the wall structure thereof.

4. Subordinate-ammunition member as claimed in claim 1, wherein said support means with the target detecting arrangement comprises a carriage which is radially extendable normal to the cylinder axis of said member.

5. Subordinate-ammunition member as claimed in claim 1, wherein said target-detecting arrangement includes deflecting optic means located proximate the cylinder wall of said member.

6. Subordinate-ammunition member as claimed in claim 1, wherein said target-detecting arrangement includes a sensor arrangement located behind a central opening in a deflecting mirror surface and a concave mirror positioned opposite thereto.

7. Subordinate-ammunition member as claimed in claim 1, wherein said target-detecting arrangement includes a prismatic member of a radiation-permeable material, said prismatic member having an outer surface forming a deflecting mirror surface, and at least one outer surface forming focusing optic means.

* * * * *